US009069305B2

(12) United States Patent
Suzuki et al.

(10) Patent No.: US 9,069,305 B2
(45) Date of Patent: Jun. 30, 2015

(54) FIXING DEVICE CAPABLE OF GROUNDING TUBULAR MEMBER

(75) Inventors: Noboru Suzuki, Komaki (JP); Kei Ishida, Nagoya (JP); Takuji Matsuno, Ichinomiya (JP); Yoshihiro Miyauchi, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 385 days.

(21) Appl. No.: 13/426,784

(22) Filed: Mar. 22, 2012

(65) Prior Publication Data

US 2012/0308254 A1 Dec. 6, 2012

(30) Foreign Application Priority Data

May 31, 2011 (JP) ..... 2011-122860

(51) Int. Cl.
*G03G 15/20* (2006.01)
*G03G 15/00* (2006.01)
*G03G 21/16* (2006.01)

(52) U.S. Cl.
CPC ..... *G03G 15/2053* (2013.01); *G03G 21/1652* (2013.01); *G03G 15/80* (2013.01)

(58) Field of Classification Search
CPC G03G 15/80; G03G 21/1652; G03G 15/2053
USPC ..... 399/90, 329
See application file for complete search history.

(56) References Cited

U.S. PATENT DOCUMENTS 5,471,288 A * 11/1995 Ohtsuka et al. ..... 399/338
5,742,878 A 4/1998 Kuroda
5,828,035 A 10/1998 Kuroda
6,014,539 A * 1/2000 Sano et al. ..... 399/329
7,209,696 B2 4/2007 Umezawa et al.
7,235,761 B1 6/2007 Maul et al.

(Continued)

FOREIGN PATENT DOCUMENTS

JP 06-003982 1/1994
JP 08-006409 1/1996

(Continued)

OTHER PUBLICATIONS

Co-pending U.S. Appl. No. 13/426,816, filed Mar. 22, 2012.

(Continued)

*Primary Examiner* — David Gray
*Assistant Examiner* — Tyler Hardman
(74) *Attorney, Agent, or Firm* — Banner & Witcoff, Ltd.

(57) ABSTRACT

A fixing device for thermally fixing a developing agent image to a sheet includes: a flexible tubular member having an inner peripheral surface defining an internal space; a heater; a nip member being in sliding contact with the inner peripheral surface of the flexible tubular member and having an electrically conductive surface; a stay supporting the nip member and being electrically conductive and electrically connected to the electrically conductive surface; a backup member nipping the flexible tubular member in cooperation with the nip member; a supporting member supporting the nip member and the stay, the supporting member being movable relative to the backup member; and a first grounding member disposed to be in contact with the stay for grounding the stay, the first grounding member being supported to the supporting member such that the first grounding member is integrally movable with the supporting member.

8 Claims, 7 Drawing Sheets

(56) References Cited

U.S. PATENT DOCUMENTS

| | | | | |
|---|---|---|---|---|
| 7,242,895 | B2 | 7/2007 | Inada et al. | |
| 7,294,810 | B1 | 11/2007 | Haseba et al. | |
| 7,792,476 | B2 | 9/2010 | Seol et al. | |
| 7,881,650 | B2 | 2/2011 | Shin et al. | |
| 8,032,069 | B2 | 10/2011 | Shin et al. | |
| 8,135,323 | B2 | 3/2012 | Suzuki et al. | |
| 8,385,801 | B2 | 2/2013 | Sugaya | |
| 8,452,218 | B2 | 5/2013 | Fujiwara et al. | |
| 8,509,667 | B2 | 8/2013 | Miyauchi | |
| 8,559,862 | B2 | 10/2013 | Kondo et al. | |
| 8,611,802 | B2 | 12/2013 | Suzuki et al. | |
| 8,725,038 | B2 | 5/2014 | Yamaguchi et al. | |
| RE45,015 | E | 7/2014 | Uchida et al. | |
| 2003/0035667 | A1* | 2/2003 | Izawa et al. | 399/333 |
| 2005/0089787 | A1* | 4/2005 | Uchinokura et al. | 430/124 |
| 2005/0163540 | A1 | 7/2005 | Umezawa et al. | |
| 2006/0133868 | A1 | 6/2006 | Kobayashi et al. | |
| 2006/0233575 | A1 | 10/2006 | Uchida et al. | |
| 2008/0056783 | A1 | 3/2008 | Yamamoto et al. | |
| 2008/0232870 | A1 | 9/2008 | Ardery et al. | |
| 2009/0092423 | A1 | 4/2009 | Shin et al. | |
| 2009/0142113 | A1* | 6/2009 | Kajita et al. | 399/328 |
| 2009/0208264 | A1 | 8/2009 | Fujiwara et al. | |
| 2009/0257794 | A1 | 10/2009 | Kaino et al. | |
| 2011/0058862 | A1 | 3/2011 | Yamaguchi et al. | |
| 2011/0058864 | A1 | 3/2011 | Fujimoto et al. | |
| 2011/0129267 | A1 | 6/2011 | Arimoto et al. | |
| 2011/0158718 | A1 | 6/2011 | Fujiwara et al. | |
| 2011/0164905 | A1 | 7/2011 | Kondo et al. | |
| 2011/0164906 | A1 | 7/2011 | Ishida et al. | |
| 2011/0170919 | A1 | 7/2011 | Fujiwara et al. | |
| 2011/0170920 | A1 | 7/2011 | Fujiwara et al. | |
| 2011/0188908 | A1 | 8/2011 | Ishida et al. | |
| 2011/0194882 | A1* | 8/2011 | Kitano et al. | 399/333 |
| 2011/0206406 | A1* | 8/2011 | Suzuki et al. | 399/90 |
| 2011/0211881 | A1 | 9/2011 | Suzuki et al. | |
| 2011/0211882 | A1 | 9/2011 | Suzuki et al. | |
| 2011/0318074 | A1 | 12/2011 | Hiramatsu | |
| 2012/0163882 | A1 | 6/2012 | Kim et al. | |
| 2012/0163885 | A1 | 6/2012 | Ishida | |
| 2012/0251138 | A1 | 10/2012 | Ishida et al. | |
| 2012/0251207 | A1 | 10/2012 | Ishida et al. | |
| 2012/0269562 | A1 | 10/2012 | Hashimoto | |
| 2013/0315640 | A1 | 11/2013 | Miyauchi | |
| 2013/0322937 | A1 | 12/2013 | Suzuki et al. | |
| 2013/0322939 | A1 | 12/2013 | Ishida et al. | |

FOREIGN PATENT DOCUMENTS

| | | |
|---|---|---|
| JP | 09-127809 | 5/1997 |
| JP | 10-247026 | 9/1998 |
| JP | 2001-147605 | 5/2001 |
| JP | 2001-356623 | 12/2001 |
| JP | 2005-166299 | 6/2005 |
| JP | 2006-047769 | 2/2006 |
| JP | 2008-233886 | 10/2008 |
| JP | 2009-053507 | 3/2009 |
| JP | 2011-003654 A | 1/2011 |
| JP | 2011-033654 A | 2/2011 |
| JP | 2011-095539 A | 5/2011 |
| JP | 2011-170239 | 9/2011 |

OTHER PUBLICATIONS

Co-pending U.S. Appl. No. 13/426,878, filed Mar. 22, 2012.
Co-pending U.S. Appl. No. 13/426,944, filed Mar. 22, 2012.
Office Action issued in corresponding U.S. Appl. No. 13/426,878 mailed Oct. 1, 2013.
Office Action issued in corresponding U.S. Appl. No. 13/426,816 mailed Dec. 18, 2013.
Notice of Allowance issued in corresponding U.S. Appl. No. 13/426,816 mailed Aug. 11, 2014.
Notice of Allowance issued in U.S. Appl. No. 13/426,878 mailed Apr. 17, 2014.
Non-Final Office Action received in corresponding U.S. Appl. No. 13/426,944 mailed Jun. 5, 2014.
Feb. 24, 2015—(JP) Office Action—App 2011-122860.

* cited by examiner

FIXING DEVICE CAPABLE OF GROUNDING TUBULAR MEMBER

CROSS REFERENCE TO RELATED APPLICATION

This application claims priority from Japanese Patent Application No. 2011-122860 filed May 31, 2011. The entire content of the priority application is incorporated herein by reference.

TECHNICAL FIELD

The present invention relates to a fixing device that thermally fixes a transferred developing agent image to a sheet.

BACKGROUND

A conventional thermal fixing device used in an electrophotographic image forming apparatus includes an endless fixing belt (tubular member), a heater disposed at an internal space of the tubular member, a backup member and a heating plate (nip member) that nips the tubular member in cooperation with the backup member. In this fixing device, a recording sheet is conveyed between the tubular member (the nip member) and the backup member for thermally fixing a developer image to the recording sheet.

SUMMARY

In the above-described fixing device, if the tubular member is charged, some developer on the recording sheet may possibly adhere to the tubular member, which may cause contamination of the backup roller or a next recording sheet. Further, when the tubular member is charged, there also arises a problem that some developer which is carried on the recording sheet but not yet fixed thereto may be disturbed. As a result, degradation in image quality could result.

In view of the foregoing, it is an object of the present invention to provide a fixing device capable of suppressing the tubular member from getting charged.

In order to attain the above and other objects, there is provided a fixing device for thermally fixing a developing agent image to a sheet. The fixing device includes: a flexible tubular member having an inner peripheral surface defining an internal space; a heater disposed at the internal space; a nip member disposed at the internal space and configured to be in sliding contact with the inner peripheral surface of the flexible tubular member, the nip member having an electrically conductive surface; a stay disposed at the internal space to support the nip member, the stay being electrically conductive and electrically connected to the electrically conductive surface; a backup member configured to nip the flexible tubular member in cooperation with the nip member; a supporting member configured to support the nip member and the stay, the supporting member being movable relative to the backup member; and a first grounding member disposed to be in contact with the stay for grounding the stay, the first grounding member being supported to the supporting member such that the first grounding member is integrally movable with the supporting member.

DETAILED DESCRIPTION

First, a general configuration of a laser printer 1 incorporating a fixing device 100 according to an embodiment of the present invention will be described with reference to FIG. 1. In the following description, a general structure of the laser printer 1 will be described first and a detailed structure of the fixing device 100 will be then described.

Throughout the specification, the terms "above", "below", "right", "left", "front", "rear" and the like will be used assuming that the laser printer 1 is disposed in an orientation in which it is intended to be used. More specifically, in FIG. 1, a right side, a left side, a near side and a far side of the laser printer 1 are referred to as a front side, a rear side, a left side and a right side, respectively.

Figure 1:
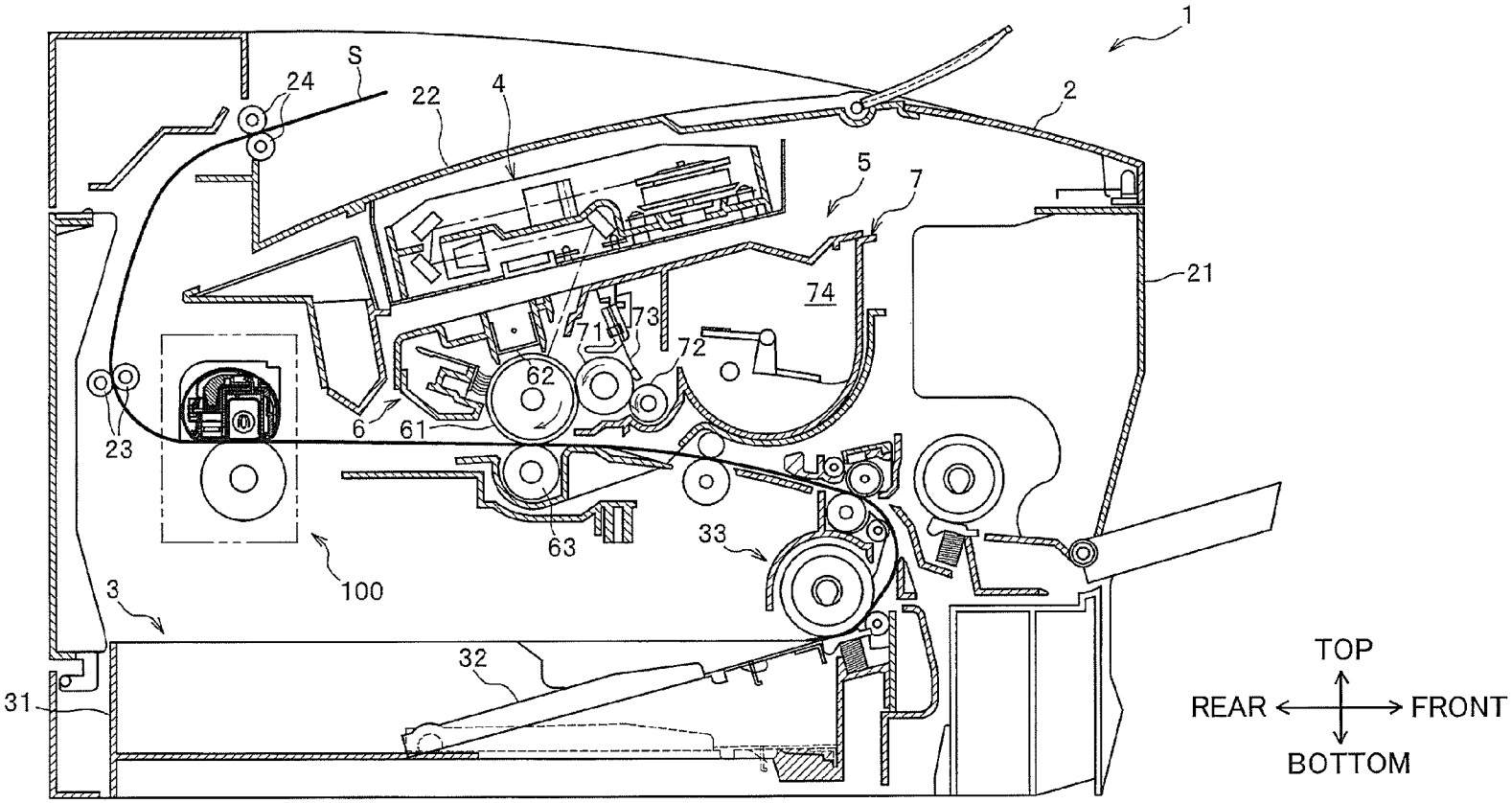
FIG. 1 is a schematic cross-sectional view illustrating a general configuration of a laser printer provided with a fixing device according to an embodiment of the present invention.

As shown in FIG. 1, the laser printer 1 includes a main frame 2 provided with a movable front cover 21. Within the main frame 2, a sheet supply unit 3 for supplying a sheet S, an exposure unit 4, a process cartridge 5 for transferring a toner image (developing agent image) on the sheet S, and the fixing device 100 for thermally fixing the toner image onto the sheet S are provided.

The sheet supply unit 3 is disposed at a lower portion of the main frame 2. The sheet supply unit 3 includes a sheet supply tray 31 for accommodating the sheet S, a lifter plate 32 for lifting up a front side of the sheet S, a sheet conveying mechanism 33. Each sheet S accommodated in the sheet supply tray 31 is lifted upward by the lifter plate 32, and is conveyed toward the process cartridge 5 by the sheet conveying mechanism 33.

The exposure unit 4 is disposed at an upper portion of the main frame 2. The exposure unit 4 includes a laser emission unit (not shown), a polygon mirror, lenses and reflection mirrors (shown without reference numerals). In the exposure unit 4, the laser emission unit emits a laser beam (indicated by a chain line in FIG. 1) based on image data such that a surface of a photosensitive drum 61 (described later) is exposed by high speed scanning of the laser beam.

The process cartridge 5 is disposed below the exposure unit 4. The process cartridge 5 is detachably loadable in the main frame 2 through an opening defined when the front cover 21 of the main frame 2 is opened. The process cartridge 5 includes a drum unit 6 and a developing unit 7.

The drum unit 6 includes the photosensitive drum 61, a charger 62, and a transfer roller 63. The developing unit 7 is detachably mounted on the drum unit 6. The developing unit 7 includes a developing roller 71, a supply roller 72, a thickness-regulation blade 73, and a toner accommodating portion 74 in which toner (developing agent) is accommodated.

In the process cartridge 5, after the surface of the photosensitive drum 61 has been uniformly charged by the charger 62, the surface is exposed to the high speed scanning of the laser beam from the exposure unit 4. An electrostatic latent image based on the image data is thereby formed on the surface of the photosensitive drum 61. The toner accommodated in the toner accommodating portion 74 is supplied to the developing roller 71 via the supply roller 72. The toner then enters between the developing roller 71 and the thickness-regulation blade 73 to be carried on the developing roller 71 as a thin layer having a uniform thickness.

The toner borne on the developing roller 71 is supplied to the electrostatic latent image formed on the photosensitive drum 61, thereby developing the electrostatic latent image into a visible toner image. The toner image is thus formed on the surface of the photosensitive drum 61. Subsequently, when the sheet S is conveyed between the photosensitive drum 61 and the transfer roller 63, the toner image formed on the photosensitive drum 61 is transferred onto the sheet S.

The fixing device 100 is disposed rearward of the process cartridge 5. The toner image (toner) transferred onto the sheet S is thermally fixed on the sheet S while the sheet S passes through the fixing device 100. The sheet S on which the toner image has been thermally fixed is then conveyed by conveying rollers 23, 24 to be discharged onto a discharge tray 22 formed on an upper surface of the main frame 2.

Next, a detailed structure of the fixing device 100 according to the embodiment of the present invention will be described with reference to FIGS. 2 through 6.

Figure 2:
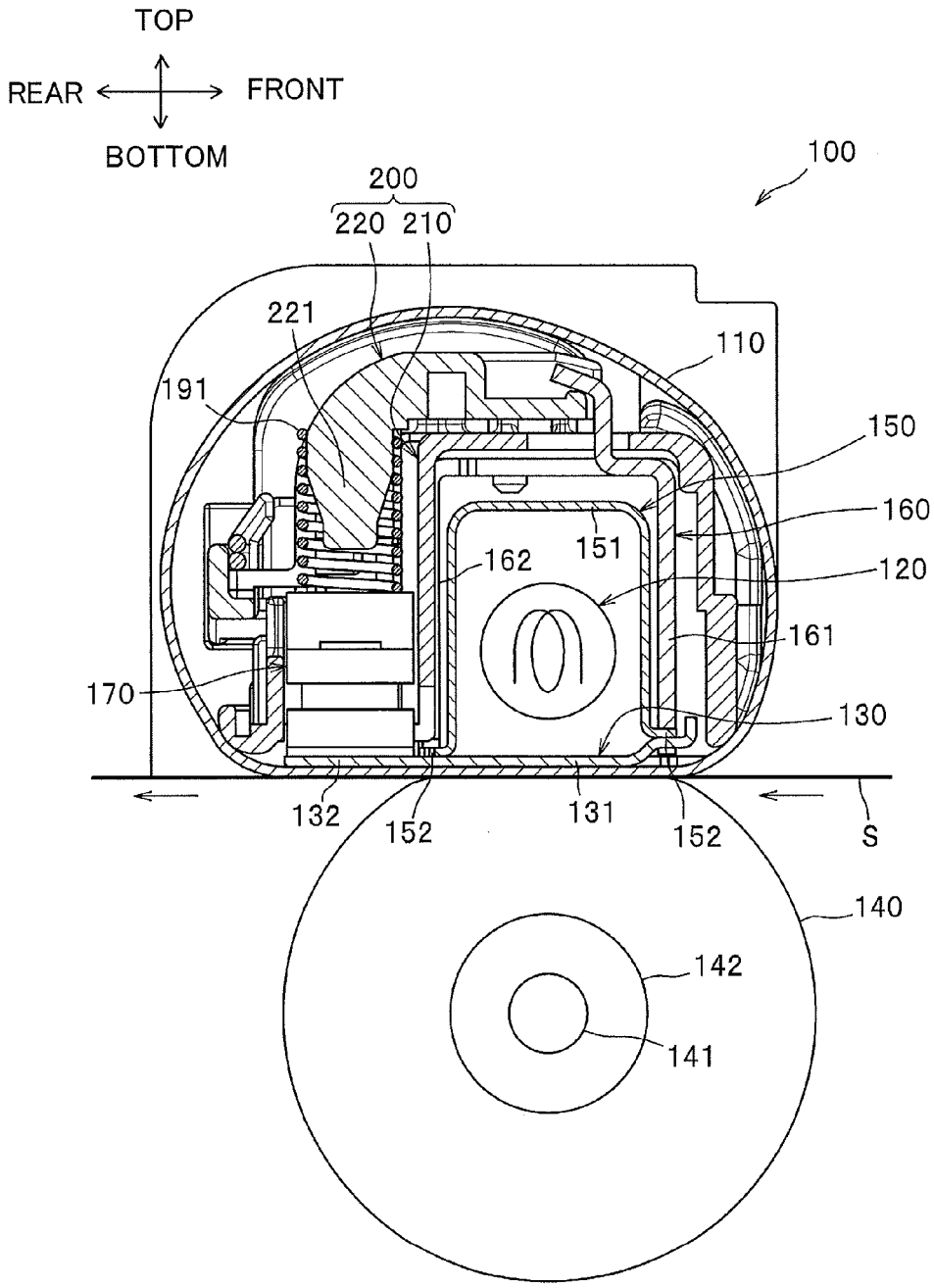
FIG. 2 is a schematic cross-sectional view of the fixing device according to the embodiment, the fixing device including a fusing belt and a backup roller.
Figure 3:
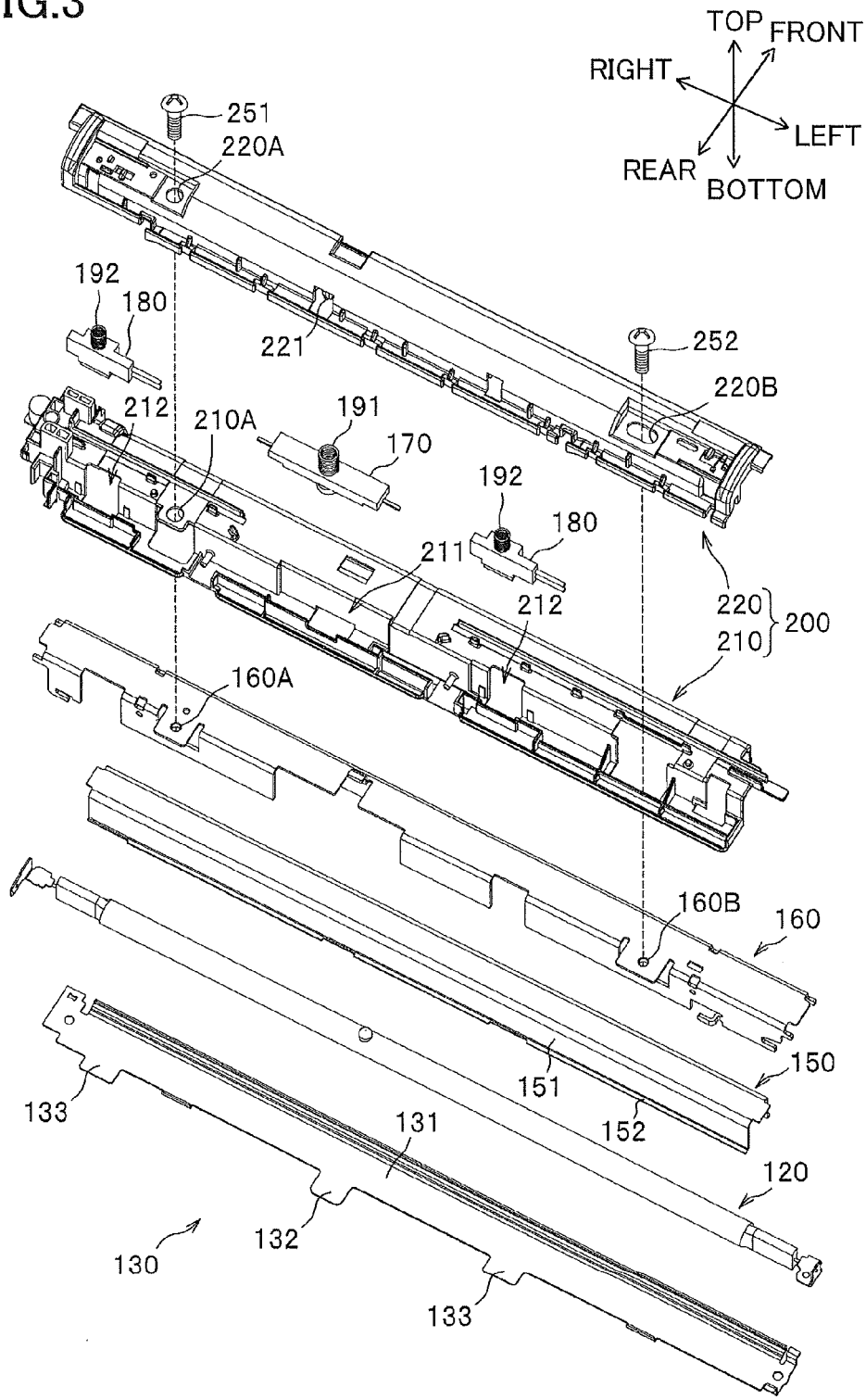
FIG. 3 is an exploded perspective view of the fixing device according to the embodiment, the fixing device including a nip plate, a halogen lamp, a reflection member, a stay, a cover member, a thermostat and two thermistors.
Figure 4:
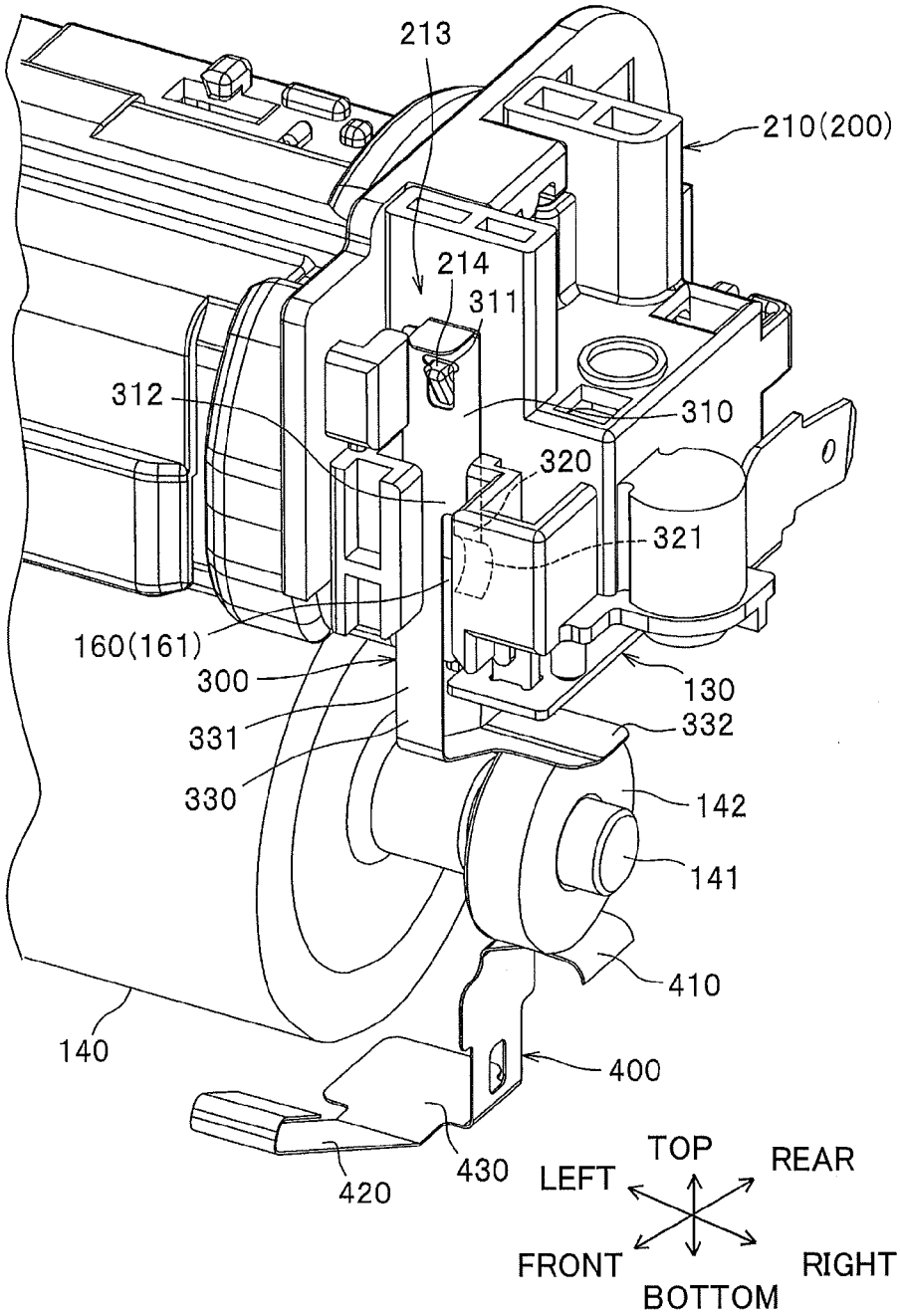
FIG. 4 is an enlarged perspective view of a right end portion of the fixing device according to the embodiment during image formation, the right end portion of the fixing device including a first grounding member and a second grounding member.

As shown in FIG. 2, the fixing device 100 includes a flexible fusing belt 110 as a tubular member, a halogen lamp 120 as a heater, a nip plate 130 as a nip member, a backup roller 140 as a backup member, a reflection member 150, a stay 160, a thermostat 170 and two thermistors 180 (see FIGS. 3, 4), a cover member 200, a first grounding member 300 (see FIG. 4) and a second grounding member 400 (see FIG. 4).

The fusing belt 110 is of an endless belt (of a tubular configuration) having heat resistivity and flexibility. The fusing belt 110 has an inner peripheral surface that defines an internal space within which the halogen lamp 120, the nip plate 130, the reflection member 150, the stay 160 and the cover member 200 are disposed. The fusing belt 110 extends in a left-to-right direction. Hereinafter, the left-to-right direction in which the fusing belt 110 extends may also be referred to as an axial direction of the fusing belt 110, wherever necessary. The fusing belt 110 has widthwise end portions in the axial direction that are guided by guide members (not shown) so that the fusing belt 110 is circularly movable. In the embodiment, the fusing belt 110 is made from a metal, for example, a stainless steel.

The halogen lamp 120 is a heater to generate radiant heat to heat the nip plate 130 and the fusing belt 110 for heating toner on the sheet S. The halogen lamp 120 is positioned at the internal space of the fusing belt 110 such that the halogen lamp 120 is spaced away from an inner surface of the nip plate 130 by a predetermined distance.

The nip plate 130 has a plate-like shape and is adapted to receive radiant heat from the halogen lamp 120. To this effect, the nip plate 130 is positioned at the internal space of the fusing belt 110 such that the inner peripheral surface of the fusing belt 110 is slidably movable with a lower surface of the nip plate 130. The nip plate 130 is made from a metal. In the embodiment, the nip plate 130 is made of aluminum having a thermal conductivity higher than that of the stay 160 (described later) made from a steel. For fabricating the nip plate 130, an aluminum plate is bent to provide a base portion 131, a first protruding portion 132, and two second protruding portions 133, as shown in FIG. 3.

The base portion 131 is flat and extends in the left-to-right direction. The base portion 131 has a lower surface that is in sliding contact with the inner peripheral surface of the fusing belt 110. The base portion 131 transmits the radiant heat from the halogen lamp 120 to the toner on the sheet S via the fusing belt 110.

The base portion 131 has a rear end portion from which the first protruding portion 132 and the two second protruding portions 133 protrude rearward respectively. Each of the first protruding portion 132 and the second protruding portions 133 has a substantially flat plate-like shape.

The first protruding portion 132 is formed at a position adjacent to a lateral center of the rear end portion of the base portion 131 in the left-to-right direction. The first protruding portion 132 has an upper surface on which the thermostat 170 is disposed to confront the same, and a lower surface that faces the backup roller 140.

The two second protruding portions 133 are formed such that one of the second protruding portions 133 is arranged at a position adjacent to a right end portion of the rear end portion of the base portion 131, while the other second protruding portion 133 is arranged at a position adjacent to the lateral center of the rear end portion but leftward of the first protruding portion 132 in the left-to-right direction. Each second protruding portion 133 has an upper surface on which one of the two thermistors 180 is disposed to face the same.

The nip plate 130 is supported to the cover member 200. The cover member 200 is biased toward the backup roller 140, and therefore the nip plate 130 is also biased toward the backup roller 140.

The backup roller 140 is disposed below the nip plate 130 such that the backup roller 140 nips the fusing belt 110 in cooperation with the nip plate 130, as shown in FIG. 2. The backup roller 140 includes a metal roller shaft 141 extending in the left-to-right direction. This roller shaft 141 is rotatably supported to a metal bearing, for example, a ball bearing 142 in the embodiment. Specifically, as shown in FIG. 4, the roller shaft 141 is inserted into and coupled to an inner race of the ball bearing 142 such that the roller shaft 141 is rotatable. The ball bearing 142 is supported to a casing (not shown) of the fixing device 100 such that the first grounding member 300 can be in contact with an upper portion of the ball bearing 142 and the second grounding member 400 can be in contact with a lower portion of the ball bearing 142, as will be described later. In the embodiment, the casing of the fixing device 100 does not have electrical conductivity. The backup roller 140 is configured to rotate upon receipt of a driving force transmitted from a motor (not shown) disposed within the main frame 2. As the backup roller 140 rotates, the fusing belt 110 is circularly moved along the nip plate 130 because of a friction force generated between the backup roller 140 and the fusing belt 110 or between the sheet S and the fusing belt 110. The toner image on the sheet S can be thermally fixed thereto by heat and pressure during passage of the sheet S between the backup roller 140 and the fusing belt 110.

The reflection member 150 is adapted to reflect radiant heat from the halogen lamp 120 toward the nip plate 130. As shown in FIG. 2, the reflection member 150 is positioned at the internal space of fusing belt 110 to surround the halogen lamp 120 with a predetermined distance therefrom. Thus, heat from the halogen lamp 120 can be efficiently concentrated onto the nip plate 130 to promptly heat the nip plate 130 and the fusing belt 110.

The reflection member 150 has a U-shaped cross-section and is made from a material such as aluminum having high reflection ratio regarding infrared ray and far infrared ray. Specifically, the reflection member 150 has a U-shaped reflection portion 151 and two flange portions 152 each extending outward (frontward or rearward) from each end portion of the reflection portion 151 in the front-to-rear direction.

The stay 160 is adapted to support each end portion of the nip plate 130 in the front-to-rear direction. The stay 160 is disposed at the internal space of the fusing belt 110 so as to cover the halogen lamp 120 and the reflection member 150. For covering the reflection member 150 and the halogen lamp 120, the stay 160 has a U-shaped configuration in conformity with an outer profile of the U-shaped reflection member 150 (reflection portion 151). For fabricating the stay 160, a highly rigid member such as a steel plate is folded into U-shape.

More specifically, the stay 160 is disposed at a side opposite to that of the backup roller 140 with respect to the nip plate 130, as shown in FIG. 2. The stay 160 has a front wall 161 whose bottom end portion supports a front end portion of the nip plate 130 from upward thereof via the flange portion 152. The stay 160 also has a rear wall 162 whose bottom end portion supports a rear end portion of the nip plate 130 from upward thereof via the flange portion 152. In other words, the nip plate 130 and the stay 160 nip the flange portions 152 of the reflection member 150 therebetween. The stay 160 has an upper wall on which two screw holes 160A, 160B are formed to receive screws 251, 252 respectively for fixing the cover member 200 to the stay 160.

The stay 160 is adapted to receive a force applied to the nip plate 130 from the backup roller 140 and to support the nip plate 130. Here, the force applied to the nip plate 130 from the backup roller 140 refers to a reaction force generated in response to a force with which the nip plate 130 biases the backup roller 140.

The thermostat 170 is configured to detect a temperature of the nip plate 130. The thermostat 170 has a lower surface serving as a temperature detecting surface. As shown in FIG. 2, the thermostat 170 is disposed at the internal space of the fusing belt 110 such that the lower surface of the thermostat 170 opposes the upper surface of the first protruding portion 132 of the nip plate 130. Further, the thermostat 170 is adapted to be coupled to a first positioning portion 211 (described later) formed on a first cover member 210 of the cover member 200. The thermostat 170 is thus positioned in the front-to-rear direction as well as in the left-to-right direction. The thermostat 170 is further biased toward the first protruding portion 132 by a coil spring 191. With this construction, the thermostat 170 is stably positioned relative to the nip plate 130. Hence, the thermostat 170 can detect the temperature of the nip plate 130 with accuracy.

The thermistors 180 are temperature sensors configured to detect the temperature of the nip plate 130. Each thermistor 180 has a lower surface serving as a temperature detecting surface. The two thermistors 180 are disposed at the internal space of the fusing belt 110 such that the lower surface of each thermistor 180 opposes the upper surface of each second protruding portion 133 of the nip plate 130.

Further, each thermistors 180 is adapted to be coupled to each second positioning portion 212 (described later) formed on the first cover member 210 of the cover member 200. The thermistors 180 are thus positioned in the front-to-rear direction as well as in the left-to-right direction. Each thermistor 180 is further biased toward each second protruding portion 133 by a coil spring 192. With this construction, the thermistors 180 are stably positioned relative to the nip plate 130. The thermistors 180 can therefore detect the temperature of the nip plate 130 with accuracy.

The cover member 200 is adapted to support the nip plate 130 and the stay 160. The cover member 200 is disposed at the internal space of the fusing belt 110 so as to cover the stay 160, as shown in FIG. 2. In the embodiment, the cover member 200 is made from a resin, for example, a liquid crystal polymer, a PEEK resin (polyether ether ketone resin), or a PPS resin (polyphenylene sulfide resin).

The cover member 200 includes the first cover member 210 and a second cover member 220, as shown in FIG. 3.

The first cover member 210 has a substantially U-shaped cross-section and extends in the left-to-right direction. The first cover member 210 includes the first positioning portion 211, two second positioning portions 212, a supporting portion 213 (see FIG. 4) and a through-hole 210A. As described above, the first positioning portion 211 serves to position the thermostat 170, and each second positioning portion 212 serves to position each thermistor 180. The supporting portion 213 serves to support the first grounding member 300, as will be described later. The through-hole 210A is formed on an upper wall of the first cover member 210 for allowing the screw 251 to penetrate therethrough. The supporting portion 213 is formed on a right end portion of the first cover member 210, more specifically, on a front surface of the right end portion of the first cover member 210, as shown in FIG. 4. The supporting portion 213 is formed to have a recessed portion that opens frontward for mounting the first grounding member 300.

The supporting portion 213 has a protrusion 214 that protrudes frontward. The protrusion 214 engages an engaging hole 311 (described later) formed on the first grounding member 300. Specifically, the protrusion 214 is formed to slope relative to a top-to-bottom direction such that the protrusion 214 approaches the front surface of the right end portion of the first cover member 210 as extending downward. This slope of the protrusion 214 serves to facilitate engagement of the protrusion 214 with the engaging hole 311 of the first grounding member 300 when the first grounding member 300 is inserted upward to be mounted on the first cover member 210.

As shown in FIGS. 2 and 3, the second cover member 220 has a substantially L-shaped cross-section and extends in the left-to-right direction. The second cover member 220 has an upper wall on which three supporting portions 221 (only one is shown in FIG. 3) and two screw holes 220A, 220B are formed. Specifically, each supporting portion 221 has a boss-like shape protruding downward from a lower surface of the upper wall of the second cover member 220 for supporting one of the coil springs 191, 192. The screws 251, 252 are respectively inserted into the screw holes 220A, 220B.

For fixing the cover member 200 to the stay 160, the screw 251 is inserted into the screw hole 220A and the through-hole 210A such so that the screw 251 can be screwed into the screw hole 160A of the stay 160. The screw 252 is screwed into the screw hole 160B via the screw hole 220B. As described above, the stay 160 supports the nip plate 130. The cover member 200 is supported to the casing (not shown) of the fixing device 100. In other words, the cover member 200 supports the stay 160, and also supports the nip plate 130 via the stay 160.

As shown in FIG. 4, the cover member 200 is biased toward the backup roller 140 by a biasing member (not shown), and is configured to be movable relative to the backup roller 140 in the top-to-bottom direction. The nip plate 130 and the stay 160 are supported to the cover member 200, and therefore the nip plate 130 and the stay 160 are integrally movable with the cover member 200 relative to the backup roller 140.

Figure 6:
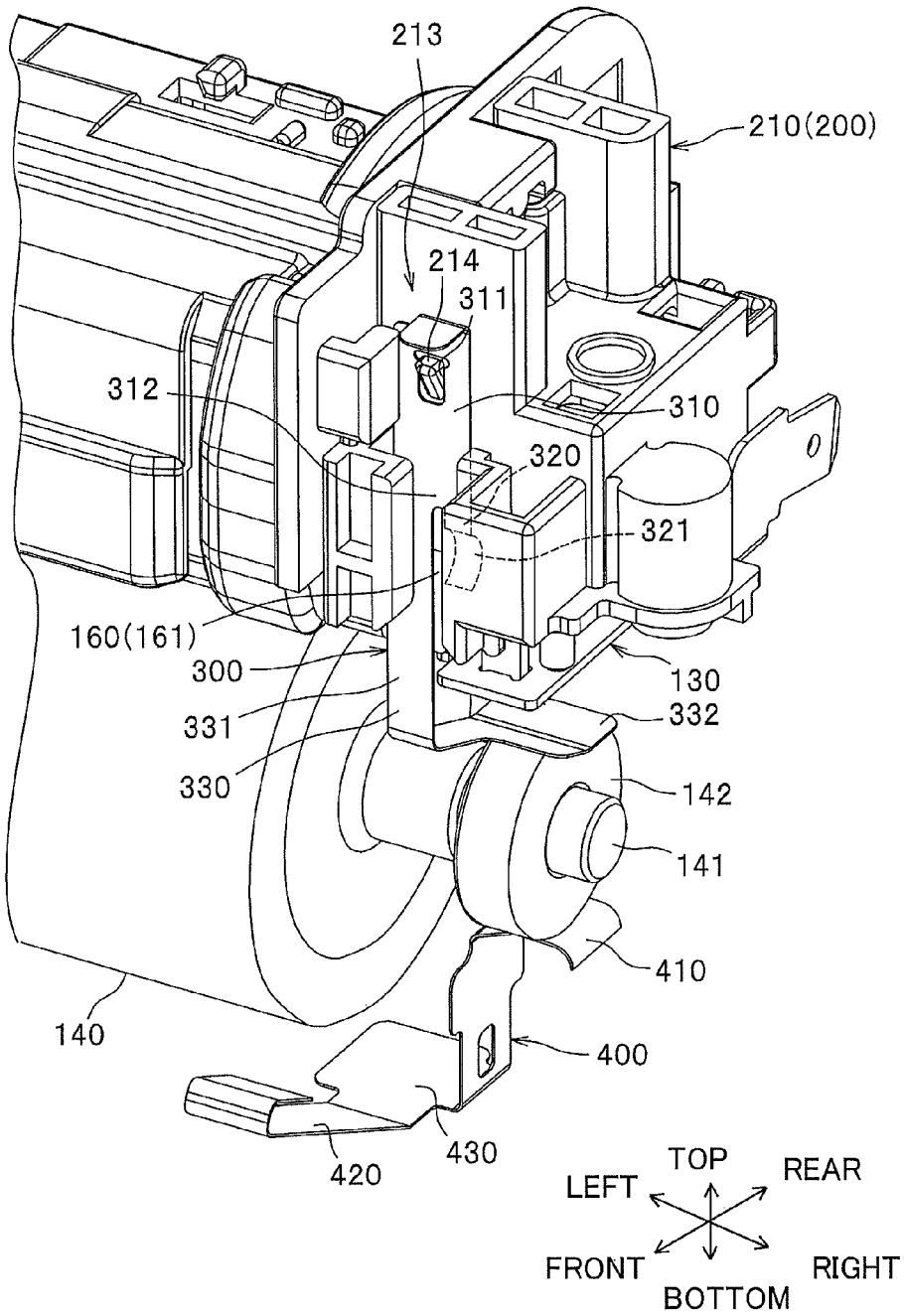
FIG. 6 is an enlarged perspective view of the right end portion of the fixing device when a paper jam is addressed.

With this construction, during image formation, the cover member 200 is moved to a position closest to the backup roller 140 such that the nip plate 130 and the backup roller 140 are in pressure contact with each other. In case that a paper jam occurs at the fixing device 100, the cover member 200 is moved away from the backup roller 140 so as to release pressure contact between the nip plate 130 and the backup roller 140, as shown in FIG. 6.

The first grounding member 300 serves to ground the stay 160. The first grounding member 300 is made from a metal plate in its entirety. The first grounding member 300 includes a mount portion 310, a first conducting portion 320 and a second conducting portion 330.

The mount portion 310 is supported to the supporting portion 213 of the first cover member 210. As shown in FIG. 4, the mount portion 310 is formed with the engaging hole 311 that is engageable with the protrusion 214 of the supporting portion 213.

The mount portion 310 has a lower end portion bifurcating into the first conducting portion 320 and the second conducting portion 330. More specifically, the first conducting portion 320 extends downward from a right end portion of the mount portion 310, and the second conducting portion 330 extends downward from a left end portion of the mount portion 310.

Figure 5:
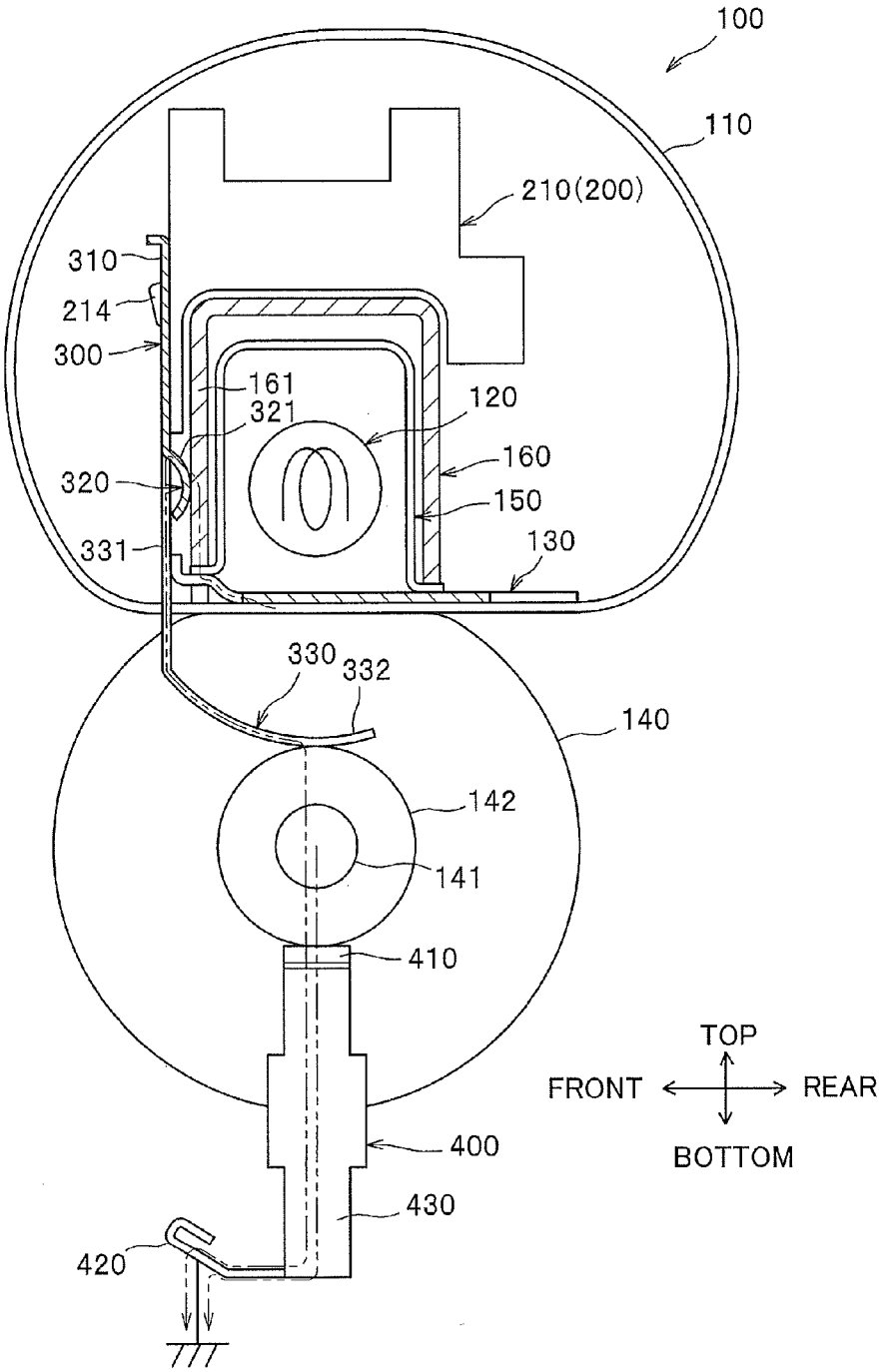
FIG. 5 is a schematic view of the right end portion of the fixing device according to the embodiment, explaining how the fusing belt is grounded via the first grounding member, the second grounding member and the backup roller.

As shown in FIG. 5, the first conducting portion 320 first extends downward and then curves to provide a curved portion 321 that is convex rearward. The curved portion 321 is in contact with the stay 160. Since the first grounding member 300 is supported to the first cover member 210 together with the stay 160, the first conducting portion 320 can be stably positioned relative to the stay 160 regardless of the movement of the first cover member 210. Hence, the first conducting portion 320 can be stably in contact with the stay 160.

Referring to FIG. 5, the second conducting portion 330 includes an extending section 331 and a first contact portion 332. The extending section 331 extends downward from the mount portion 310. The first contact portion 332 extends diagonally downward and rearward from a bottom end portion of the extending section 331. The first contact portion 332 is adapted to be in contact with the ball bearing 142 of the backup roller 140.

The first contact portion 332 has a substantially L-shape in a top view, as shown in FIG. 4. A portion of the first contact portion 332 that is in contact with the ball bearing 142 has a width wider than that of remaining portion of the first contact portion 332 in the left-to-right direction.

When the nip plate 130 and the backup roller 140 are in pressure contact with each other, the first contact portion 332 is in contact with an outer race of the ball bearing 142 (see FIGS. 4 and 5). When the nip plate 130 is separated from the backup roller 140, the first contact portion 332 is in separation from the outer race of the ball bearing 142, as shown in FIG. 6. The extending section 331 is designed to have a length in the top-to-bottom direction that allows the first contact portion 332 to be in contact with and separated from the outer race of the ball bearing 142, depending on the position of the nip plate 130 relative to the backup roller 140. With this construction, a force exerted on the second conducting portion 330 and the ball bearing 142 can be made smaller, compared to a construction in which the second conducting portion 330 is always in contact with the ball bearing 142.

Referring to FIG. 5, the first conducting portion 320 is positioned closer to the second grounding member 400 than the mount portion 310 to the second grounding member 400 in the top-to-bottom direction. The second conducting portion 330 bridges between the mount portion 310 and the first conducting portion 310. In other words, the first conducting portion 320 and the second conducting portion 330 are connected via a connecting portion 312 (see FIG. 4) that is positioned closer to the second grounding member 400 than the mount portion 310 to the second grounding member 400 in the top-to-bottom direction. This arrangement of the first conducting portion 320 and the mount portion 310 contributes to downsizing of the first grounding member 300, compared to an arrangement in which the first conducting portion 320 is connected to the mount portion 310 such that the first conducting portion 320 is positioned farther from the second grounding member 400 than the mount portion 310 from the second grounding member 400.

Further, both of the first conducting portion 320 and the second conducting portion 330 extend downward from the mount portion 310. Hence, the first grounding member 300 can be assembled to the first cover member 210 by inserting the mount portion 310 into the supporting portion 213 from downward of the first cover member 210 for engaging the engaging hole 311 with the protrusion 214.

The second grounding member 400 serves to ground the roller shaft 141 of the backup roller 140 via the ball bearing 142. The second grounding member 400 is made from a metal plate and is positioned below the ball bearing 142. The second grounding member 400 includes a second contact portion 410, a grounding portion 420, a connecting portion 430 connecting the second contact portion 410 and the grounding portion 420.

The second contact portion 410 has an arcuate shape in a front view such that the second contact portion 410 extends in the left-to-right direction and is convex upward so as to be in contact with a lower surface of the ball bearing 142. The connecting portion 430 has a substantially L-shape, extending from a left end portion of the second contact portion 410 first downward below the backup roller 140 and then leftward. The connecting portion 430 is supported to the casing (not shown) of the fixing device 100. The grounding portion 420 is a leaf spring, extending diagonally upward and frontward from a front end portion of the connecting portion 430. The grounding portion 420 is electrically grounded via a grounding member (not shown) disposed within the main frame 2.

In the present embodiment, "electrical grounding" does not only mean that the second grounding member 400 is maintained at 0V, but also mean that the second grounding member 400 is maintained at a prescribed voltage, such as 5V or 10V, by providing a semiconductor that generates a predetermined voltage in a path of grounding the second grounding member 400. Further, the grounding member disposed within the main frame 2 may be connected to a ground terminal of an electric outlet, or to a metal frame having a substantially large electric capacitance and disposed within the main frame 2.

In the fixing device 100 having the above-described configuration, the fusing belt 110 is in contact with the nip plate 130, thereby electrically connected thereto. The nip plate 130 nips the reflection member 150 in cooperation with the stay 160, thereby electrically connected to the stay 160 via the reflection member 150. That is, the fusing belt 110 is electrically connected to the stay 160 via the nip plate 130 and the reflection member 150. In this way, the fusing belt 110 is electrically grounded via the stay 160, the first grounding member 300, the ball bearing 142 and the second grounding member 400.

On the other hand, the roller shaft 141 of the backup roller 140 is electrically connected to the second grounding member 400 via the inner and outer races of the ball bearing 142. The roller shaft 141 of the backup roller 140 is thus electrically grounded via the second grounding member 400.

With this construction, the fusing belt 110, which is electrically connected to the stay 160, can be electrically grounded via the stay 160 which is grounded by the first grounding member 300. The fusing belt 110 is thus suppressed from being charged, thereby suppressing degradation in print images from occurring.

Further, the first grounding member 300 is supported to the cover member 200 such that the first grounding member 300 is integrally movable with the cover member 200 that supports the nip plate 130 and the stay 160. Hence, the stay 160 and the first grounding member 300 are stably positioned relative to each other, leading to stable grounding of the stay 160 by the first grounding member 300.

The backup roller 140 includes the roller shaft 141 and the ball bearing 142 both made from a metal. The roller shaft 141 is grounded by the second grounding member 400 via the ball bearing 142. Also, the first grounding member 300 is electrically connected to the second grounding member 400 via the roller shaft 141 and the ball bearing 142. With this construction, grounding of the fusing belt 110 and the backup roller 140 can be achieved via a single path after the ball bearing 142 (via the ball bearing 142, the second grounding member 400, and thereafter).

The nip plate 130 and the stay 160 nip the reflection member 150 made of a metal. Hence, the nip plate 130 and the stay 160 can be electrically connected to each other, although the stay 160 supports the nip plate 130 via the reflection member 150.

Further, the nip plate 130 and the stay 160 of the present embodiment are made from a metal. Therefore, fabricating the nip plate 130 and the stay 160 can be easier compared to a construction in which the nip plate 130 and the stay 160 are formed of a material without electrical conductivity whose surface is coated with a metal layer.

Further, in the embodiment, the fusing belt 110 is also formed of a metal. Therefore, simply bringing the nip plate 130 into contact with the fusing belt 110 can realize electrical connection between the fusing belt 110 and the nip plate 130.

In the first grounding member 300 of the present embodiment, the first conducting portion 320 contacting the stay 160 is disposed closer to the second grounding member 400 than the mount portion 310 to the second grounding member 400. The connecting portion 312 connecting the first conducting portion 320 and the second conducting portion 330 is also disposed closer to the second grounding member 400 than the mount portion 310 to the second grounding member 400. As a result, a distance between the first conducting portion 320 and the second grounding member 400 can be made shorter, enabling the first grounding member 300 to be compact.

Further, the direction in which the first conducting portion 320 extends from the mount portion 310 (downward) is identical to that in which the second conducting portion 330 extends from the mount portion 310. Hence, assembly of the first grounding member 300 to the cover member 200 can be facilitated.

Various changes and modifications are conceivable.

For example, the first grounding member 300 is not necessarily supported directly to the cover member 200 (first cover member 210). Instead, the first grounding member 300 may be supported to the cover member 200 indirectly via a member provided separately from the cover member 200.

Further, the fusing belt 110, the nip plate 130, the reflection member 150 and the stay 160 are all made from a metal in the depicted embodiment. However, the fusing belt 110, the nip plate 130, the reflection member 150 and the stay 160 may be formed of an electrically conductive resin. Still alternatively, the fusing belt 110, the nip plate 130, the reflection member 150 and the stay 160 may have electrically conductive surfaces. In this case, the fusing belt 110, the nip plate 130, the reflection member 150 and the stay 160 may be formed of a material without electric conductivity whose surface is coated with a metal layer.

Figure 7:
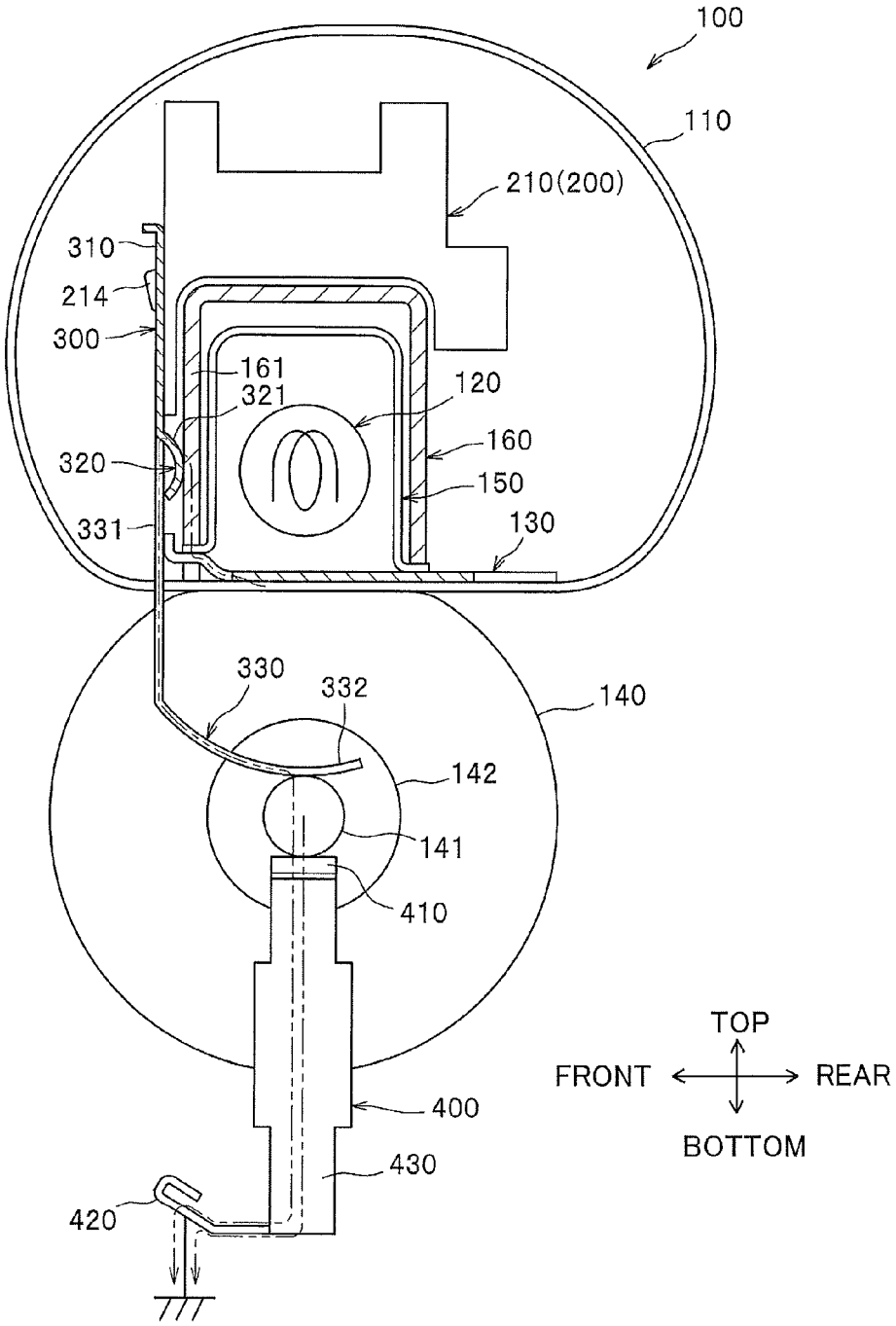
FIG. 7 is a schematic view of a right end portion of a fixing device according to a variation of the present embodiment.

In the depicted embodiment, the first contact portion 332 of the first grounding member 300 and the second contact portion 410 of the second grounding member 400 are in contact with the ball bearing 142. In case that a bearing of the backup roller 140 is made from a resin without electric conductivity, the first contact portion 332 and the second contact portion 410 may be in direct contact with the roller shaft 141 of the backup roller 140, as shown in FIG. 7.

The first grounding member 300 and the second grounding member 400 are not necessarily to be formed as separate members, but be integrally formed with each other.

Instead of the thermostat 170, a thermal fuse is also available as the electronic components.

Instead of the backup roller 140, a belt-like pressure member is also available as the backup member.

Further, instead of the halogen lamp 120, a carbon heater or an IH heater may also be available as the heater.

Further, the sheet S can be an OHP sheet instead of a plain paper and a postcard.

Further, in the depicted embodiment, the present invention is applied to the monochromatic laser printer 1 as an example of an image forming apparatus. However, the present invention may also be applicable to a color laser printer, and other image forming apparatuses such as a copying machine and a multifunction device provided with an image scanning device such as a flat head scanner.

While the invention has been described in detail with reference to the embodiments thereof, it would be apparent to those skilled in the art that various changes and modifications may be made therein without departing from the spirit of the invention.

What is claimed is:

1. A fixing device for thermally fixing a developing agent image to a sheet comprising:

a flexible tubular member having an inner peripheral surface defining an internal space;

a heater disposed at the internal space;

a nip member disposed at the internal space and configured to be in sliding contact with the inner peripheral surface of the flexible tubular member, the nip member having an electrically conductive surface;

a stay disposed at the internal space to support the nip member, the stay being electrically conductive and electrically connected to the electrically conductive surface;

a backup member configured to nip the flexible tubular member in cooperation with the nip member, the backup member including a shaft having an electric conductivity;

a supporting member configured to support the nip member and the stay, the supporting member being movable relative to the backup member;

a first grounding member disposed to be in contact with the stay for grounding the stay, the first grounding member being supported by the supporting member such that the first grounding member is integrally movable with the supporting member; and a second grounding member connected to the shaft for grounding the shaft, the first grounding member being movable relative to the second grounding member in conjunction with movement of the supporting member relative to the backup member, the second grounding member being electrically connectable to the first grounding member via the shaft.

2. The fixing device as claimed in claim 1, wherein the first grounding member comprises:

a supported portion supported by the supporting member;

a first conductive portion in contact with the stay and connected to the supported portion at a connecting portion; and a second conductive portion connected to the first conductive portion via the connecting portion and electrically connected to the second grounding member;

wherein the first conductive portion is positioned closer to the second grounding member than the supported portion to the second grounding member, and the connecting portion is positioned closer to the second grounding member than the supported portion to the second grounding member.

3. The fixing device as claimed in claim 2, wherein the first conductive portion extends from the supported portion in a direction, and the second conductive portion extends from the supported portion in a direction identical to the direction of the first conductive portion.

4. The fixing device as claimed in claim 3, wherein the first conductive portion and the second conductive portion are bifurcated in an identical direction from the supported portion at the connecting portion.

5. The fixing device as claimed in claim 1, further comprising a reflection member configured to reflect a radiant heat from the heater toward the nip member, the reflection member being electrically conductive;

wherein the nip member and the stay nip the reflection member therebetween to achieve electrical connection between the nip member and the stay.

6. The fixing device as claimed in claim 1, wherein the nip member and the stay are formed of an electrically conductive metal.

7. The fixing device as claimed in claim 1, wherein the flexible tubular member is formed of an electrically conductive metal.

8. The fixing device as claimed in claim 1, wherein the supporting member is made of a resin and configured to cover the stay.

* * * * *